United States Patent [19]

McKinney

[11] 4,002,268

[45] Jan. 11, 1977

[54] VOLUMETRIC FILLING SYSTEM

[76] Inventor: Harold D. McKinney, Rte. 4, Box 404, Pine Bluff, Ark. 71601

[22] Filed: Mar. 19, 1975

[21] Appl. No.: 559,859

[52] U.S. Cl. ..... 222/1; 222/437; 222/442; 222/479

[51] Int. Cl.[2] ..... G01F 11/28

[58] Field of Search ..... 141/1–12, 141/285–311, 392, 59, 18, 39–46; 222/1, 437, 438, 442, 479

[56] References Cited

UNITED STATES PATENTS 2,912,830 11/1959 Coldren et al. ..... 141/2

*Primary Examiner*—Houston S. Bell, Jr.
*Attorney, Agent, or Firm*—Nathan Edelberg; Robert W. Church

[57] ABSTRACT

A new filling process for liquids and slurries.

12 Claims, 8 Drawing Figures

VOLUMETRIC FILLING SYSTEM

The invention described herein may be manufactured and used by or for the Government for Governmental purposes without the payment of any royalties thereon or therefor.

BACKGROUND OF THE INVENTION

The present invention relates generally to the field of munition payload filling processes and to other liquid and guasi-liquid filling processes where precise quantities are dispensed.

Persons working in the munitions-making field are now and have been plagued with a multitude of problems. Aside from the hazards of making lethal munition materials, per se, problems of assembling the various components to make up a munition which is economically made and possesses the optimum in reliability and safety characteristics are ever present. My invention cures one of those problem areas. It deals with a new, unobvious and reliable way of filling munition canisters and housings with payload materials.

In the past, processes of filling liquids and quasi-liquids such as acids, chemicals, solutions, slurries, etc. in containers have had shortcomings. These shortcomings have been compounded when volatile, combustible, and flammable materials have been placed in containers. The more complex the equipment, and involved the process is, the more prone to breakdown the system becomes. Any malfunction in a process involving incendiaries, flame agents, explosives, and toxic can create irreparable harm and injury to both person and property.

Numerous methods of filling containers and canisters with liquids are known and are in use.

The gravity or weight method is used. Here the material is progressively weighed in either the container per se or an ancillary continer until the proper amount is had. Thereat the filling is stopped. Various scales have been used including electronics, lever, etc. types coupled with or without automatic dumps. However, in the potentially dangerous fill material area wherein corrosion, and erosion of the filling apparatus has been common place, this technique has been found unworkable.

Dip filling has been long known and in fact would appear to stem from caveman times. Here the container to be filled, or, the filler scoop is dipped or submerged into the filling material to a specific depth to thereby fill it and then it is removed therefrom. A good example is the water dipper. It was conventionally used in years gone by, i.e., before the advent of indoor plumbing.

Gravity or pressure-time fill has also been a common use technique. Here, the liquid or quasi-liquid, is flowed into the container or filler mechanism after empirical and/or calculated data indicates a certain amount of material has passed through the outlet. Then a valve, for example, can control flow.

Of the above cited well-known process of filling containers and canisters, all have drawbacks and all do not repeditively provide the same amount of fill in each container. Especially, when used in the acids, chemicals, solutions, slurries and petroleum products area. Corrosion and erosion of the filling apparatus presents numerous problems. The fewer moving parts and automated steps involved diminish the breakdown time; i.e., in the dip method, for example, chain and gear driven conveyors where toxic material is used cause numerous problems of wear, lubrication, deterioration and disintegration to occur. In the pump and gravity methods by weight measure techniques the measure apparatus is of constant concern. In the time method of fill techniques, the apparatus plus viscosity and velocity problems create constant deviations. In all of the above cases isolated atmosphere filling compounds existing problems.

My invention was conceived and reduced to practice to solve the above described problems and to satisfy the long-felt need of providing constant, reliable and safe fills in this difficult to work with area of acids, toxics, chemicals, solutions, munition payloads, slurries and petroleum products where fire and blasts due to explosions and implosions are common place.

Briefly, my invention is a new reliable and safe process of filling canisters and containers of varying sizes and shapes with the same volume of liquid or quasi-liquid natural. It works on the differential pressure principle. That is, a volumetric cylinder or container is accurately and repeditively filled with the liquid or quasi-liquid fill material in constant amounts by using an overflow or vent tube to equalize the pressure. More specifically, a fill line from a supply source is used and a parallel return line is used. The fill material flows to the volumetric cylinder from the source until an equal pressure minus friction is had. Once this occurs no more fill material will flow therefrom. Hence, a static condition exists so that repeditively this same amount of fill material will always come into the cylinder if the same conditions exist. That is, if the cycle be repeated the cylinder is filled with the same amount of fill material.

My invention provides for exacting and uniform amounts of liquid or quasi-liquid amounts to be deposited in canisters and containers. Further, and most importantly, by the use of my process, less moving parts are used so that hard to work with acids, chemicals, solutions, mixtures, slurries, etc. of diverse materials can be controllably placed and deposited in containers.

A principal object of my invention is to provide a process of uniformly measuring and transferring materials to containers or packages;

Another object of my invention is to provide a process of measuring and transferring materials in fluid form to containers or packages;

A further object of my invention is to provide a process of measuring and transferring materials in liquid and quasi-liquid form to containers or packages;

A still further object of my invention is to provide a process of measuring and transferring materials in the form of explosives and flammables and other hazardous materials in liquid and quasi-liquii form into containers and packages in uniform quantities.

Other objects will become more apparent after considering the following description of the invention in conjunction with the accompanying drawings.

DESCRIPTION OF MY INVENTION

Figure 4:
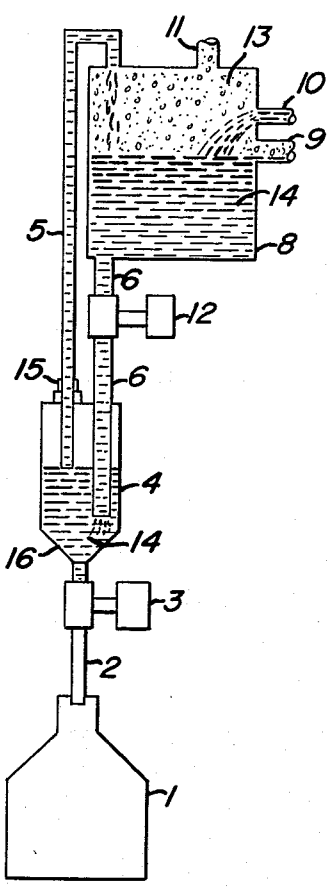
FIGS. 2–8 depict the various stages of my new filling process using the above simplified apparatus.
Figure 3:
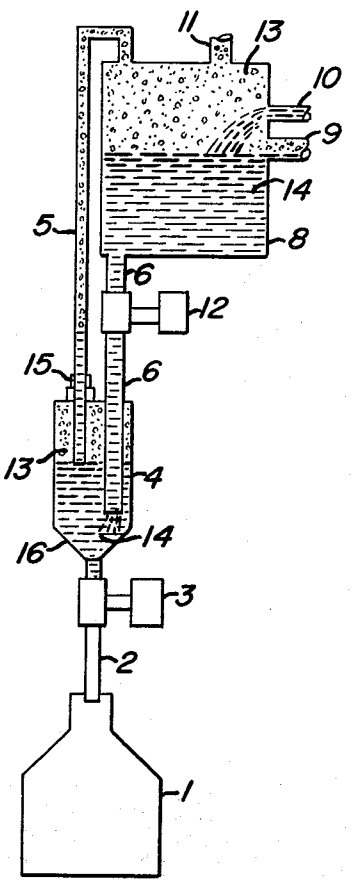
Figure 2:
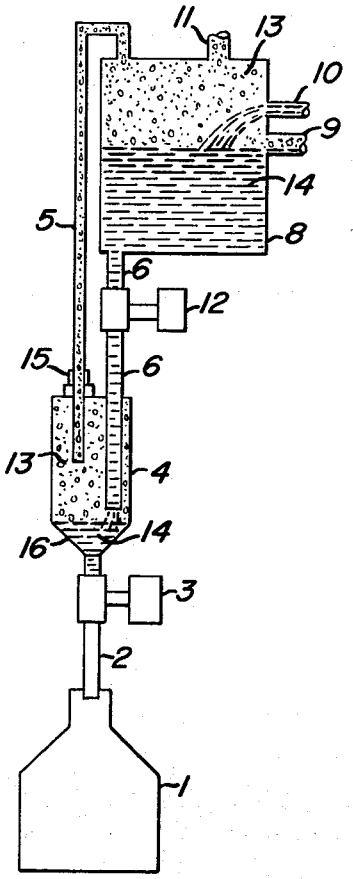
Figure 1:
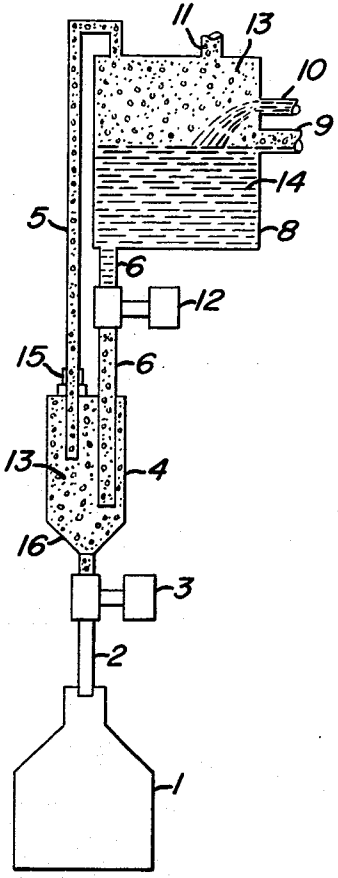
FIG. 1 shows the simplified apparatus depicting my process before it has commenced.

Referring to FIG. 1, numeral 1 is a canister, package or container to be filled. Numeral 14 is fill material in flowable form; i.e., either liquid, or slurry form preferrably. However, it is understood that granulated or certain powder material would work as well. My process can be used for anything from milk to white phosphorous material in liquid form. And it can be used with varying degrees of viscosity. Numeral 4 is my volumetric cylinder that assures constant, reliable and repeditive proformance of my process. Herein is where the fill material 4 is quantity measured. Element 3 is the lower volumetric cylinder control valve which controls the fill material flow from the cylinder 4 by way of connecting pipe 2. Valve 3 cn be mechanically actuated in any conventional manner. That is, electronical, by hand or mechanical remote control linkages are conventional modes therefor. The only critical thing is, that same should remain closed until cylinder 4 contains the proper amount of fill material 14. Supply Tank 8 shown upwardmost, contains fill material 14. Since this is a gravity fill method it is critical that the fill material 14 have a constant head. That is, heighth. Hence, return or overflow pipe 9 connected to the fill material main supply, not shown, functions to enable the material 14 to be always at the same level otherwise it will flow back into the main supply thereby. To assure that supply tank 8 is always provided with the constant heat (here determined by the lowermost portion of pipe 9) pipe 10 is the means by which material 14 is at the constant head level especially when fill material 14 is flowed into volumetric cylinder 4. To control the flow of fill material 14 from supply tank 8 to volumetric cylinder 4, I use valve 12. It can be of any variety and made to work in numerous ways; i.e., solenoid (electronic), mechanical linkage, know, etc. Valve 12 can so also be called a dump valve. Pipe 6, to which valve 12 is affixed, serves to transfer the liquid, or quasi-liquid fill material from tank 8 to volumetric cylinder 4. It can be adjustable; i.e., in depth of penetration into volumetric cylinder 4. This alternative and the purpose thereof can be explained later. Leftmost and adjustably extending at 15 from volumetric cyllinder 4 to the upper portion of tank 8 is vent or return vent 5 through which surplussage fill material 14 can flow if need be (to be explained later). Since my process can be devoid of atmospheric influences; i.e., atmosphere air or gas pressure and function in an inert or non-atmospheric environment numeral 13 represents such a medium. Since constant pressure is most critical to my process, I find it necessary to have vent means in supply tank 14 so that my process functions at its optimum efficiency and that reoccurring, consistent and repeditie results are had. This comes about by having a constant bleed off of fluid gas 13 pressure at 11 or by having a relief or control valve (not shown) controlling pressure for either inward or outwad fluid or gas 13 flow. Throughout my description all numerals of the various figures will be the same.

PROCESS OF OPERATION

Referring first to FIG. 1, I now will escribe my new and unobvious process of filling, (including diverse sizes and shapes) containers with like amounts of fill material 14. Container, canister, or receptacle 1 is relatively associated with the outlet of pipe 2 so that it is ready to receive material 14. Note, at this point, valve 12 is closed, return tube 5 is secured and at a constant heighth, and a head of material 14 is had in supply tank 8. Here also the main supply pipe 10 is assuring us that tank 8 is at desired head and that input therefrom is going out overflow pipe 9. Valve 3 is closed. First, dump valve 12 is opened. This creates a fluid displacement in volumetric cylinder 4. That is, as fill material 14 flows from tank 8 through pipe 6 past valve 12 into cylinder 4 the air or inert fluid 13 in volumetric cylinder 4 is forced through return vent tube 5 back to tank 8 to thereby form a blanket 13 over fill material 14 in tank 5.

Figure 8:
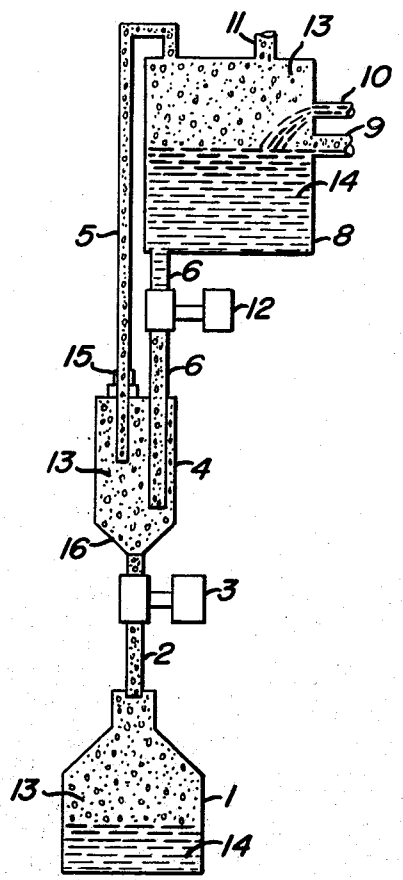
Figure 7:
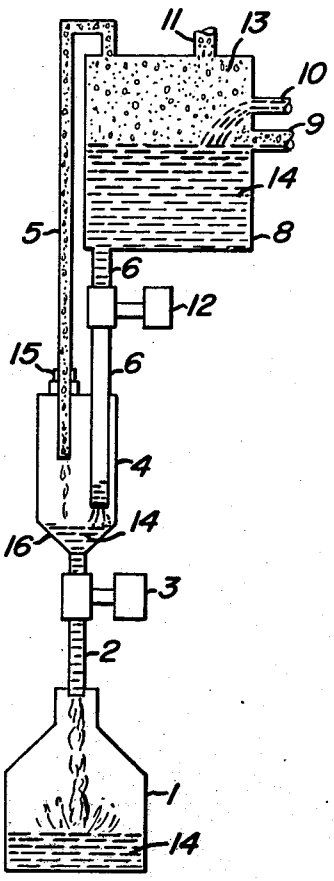
Figure 6:
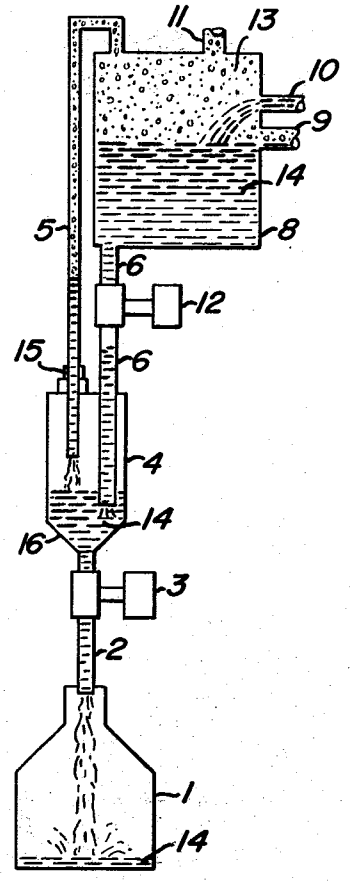
Figure 5:
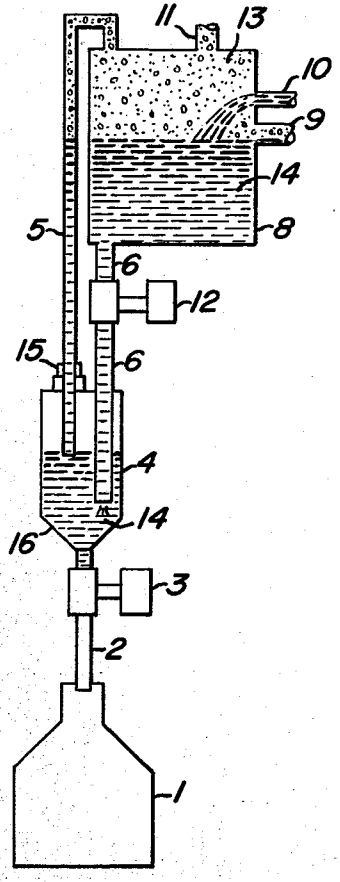

Referring to FIGS. 2–5, fill material 14 continues to fill volumetric cylinder 4 as shown. This phenomenon continues until the fill material 14 finds its own level; i.e., that of tank 8 theoretically (see FIG. 5). However, this will not occur, exactly, because of friction in tube 5. So also, because of that which occurs in FIG. 4. Here, in line with Newton's law, "matter once in motion continues in motion unless acted upon by external force". That is, due to the speed of fill, etc., a slight over shot will occur unless my process is practiced slowly. Once the over-shot flow stops, no more filling of the volumetric material occurs. That is, unless the system is modified or altered a static condition exists. Referring to FIGS. 6–8 transfer of a prescribed quantity of material 14 from volumetric cylinder 4 to container 1 can be had. First, valve 12 should be closed. Then valve 3 can be opened. This will then allow all material 14 below valve 12, that in cylinder 4, and that in return tube 5 to flow through pipe 2 past valve 3 into container 1. Once all flow has stopped, valve 3 is closed. Container 1 is now filled. The reverse has occurred now. The fluid 13 replaced the liquid or quasi-liquid 14 as first shown in FIG. 6. Here note how the liquid level or the liquid gas interface in return vent tube 5 has dropped in FIG. 6. It has been replaced by fluid 13 as is shown in FIG. 7. Reference to FIG. 8 shows that the transfer into container 1 is complete and that fluid 13 has completely displaced that of the fill material 14. Next, valve 3 is closed to prevent further escape of fluid or gas 13 from cylinder 4. After removing container 1 relatively from beneath the pipe 2 an empty container can be substituted therefor and the process repeated.

Adjustment of the quantity of material measured and ready for transfer is easily had. My unique and unobvious process is complimented by a simple adjustment technique. Here, merely by raising or lowering return vent tube 5 within cylinder 4 the amount of fill material is quanitatively varied. This is best shown by viewing FIG. 5. If return vent tube 5 is raised or withdrawn a distance from its present position, then the pressure head differential will be modified until a static condition again exists. This will not occur unless valve 12 be open, of course. Cylinder 4 will then be filled to a greater heighth; i.e., until the liquid or quasi-liquid 14 level in return vent tube 5 is equal to the head in tank 8 minus friction loss and deviation due to volumetric compression of the fluid 13 above the fill material 14. If it is desired to reduce the amount to be dispensed from the cylinder 4 then the anthithisis must be done. That is, return vent tube 5 must be caused to move downwardly farther into cylinder 4. The result is that the amount of fill material in cylinder 4 will be relatively reduced.

The most important component to make my process workable is of course my unique volumetric cylinder 4 which asures one of reliable, repeditive, and consistent fills. It can be any size and of any general shape. For most efficient results, of course, it should have a lower portion adaptable for ready emptying; i.e., with a declining surface 16, for example, It is critical that it be a substantially sealed unit; i.e., excepting for orifice means for the outlet as represented by pipe 2, the vent tube return 5 orifice, and supply pipe 6 access means. So also it should be of such construction so as to hold the fill material and hold the pressures of the fluid or gas medium so as to not be distorted. Stainless steel of the type used on commercial machinery has been used with success.

The distance pipe 6 extends into cylinder 4 is dependent upon the desired minimum capacity level of the cylinder. That is, it should be nearest the bottom of the cylinder if vast adjustment is desired because, to properly operate pipe 6 must always be lower than the lowest most point of return vent tube 5.

Defined in another way my process controllably regulates the deposites a quantity of liquid or slurry and/or liquid-like material 14 in a measuring means 4 from a supply means 8. The amount of material 14 dispensed with my process is always the same amount, that is, unless I desire to modify the amount allowed to flow into columetric cylinder 4. My process is a closed loop made up essentially of supply means 8 with material 14 gravity feeding receiver or dispenser 4 by way of feed line 6 and return vent line 5. The length of the loop is modified within receiver 4 by adjusting the depth of return line 5 relative to feed line 6 which must be always lower or at least equal in depth to line 5. Essentially, my process is the use of two different or dual fluids; i.e., 13 and 14. One must be heavier. Here, as before described, I choose to make material 14 more viscose. Gravity causes the heavy fluid 14 to be conducted into receiver 4 by way of feed line 6 and thereby displace lighter immiscible fluid 13 therefrom. Any type material 13 can be used; i.e. from any gas to air. Also, any liquid or slurry 14 can be used as that which is to be dispensed. Constant flow of the dispensed fluid 14 into supply tank 8 of course makes for more accurate cyclic dumps.

A machine to practice my process can take diverse shapes. The real criticalities lie in the requirements that tank 8 must be elevated above volumetric cylinder 4 for gravity operation; that a feed line 6 extends as far as possible to the bottom of cylinder 4; and a vent return tube 5 must be affixed in sustantially the way depicted in the drawings. Materials to make up the machine may be varied. Glass to stainles steel depending upon the dictates of the fill material would be aceptable. Also, the fluid 13 may consist of aything lighter than the fill material and immiscible with it. Also, cylinder 4 must be sealed and elements 5 and 6 sealed as well.

For the practice of my process, the following components were used to place white phosphorus in ammunition canisters.

Referring to FIG. 1, tank 8 is mounted (on support means not shown) in a raised position and comprises an 18 inch diameter, 30 inch long tank of stainless steel. Relief vent 11 is a 1 ½ inch diameter hole. Supply pipe 10 is of stainless steel and 1 ¼ inches in diameter and is welded to tank 8. Overflow pipe 9 is of stainless steel and 1 ½ inches in diameter and is connected to the main supply as is supply pipe 10. Feed pipe 6, threadably secured to tank 8 (not shown) is 1 ½ inch stainless steel, "sch 40" pipe. Valve 12 of stainless steel is a 2 inch ball valve with a "teflon" seat, threadably secured to pipe 6. Valve 3 is a ¾ inch stainless steel ball valve with a "teflon"l seat threadably secured to segments of ¾ inch sch 40 stainless steel pipe 2. Volumetric cylinder 4 of 3 inch diameter Sch 40 stainless steel pipe is 10 inches long with a 700–1000 mil. capacity and with the conical lower portion thereof welded thereto.

In operation, white phosphorus in liquid form is flowed into tank 8 under inert atmosphere 13 which is a blanket of carbon dioxide.

Referring to FIGS. 1–8, the same steps are involved excepting that a sealed interconnection is necessary between container 1 and the outlet portion of pipe 6. This is necessary because white phosphorus deleteriously reacts with oxygen.

In summary, my invention process can be used in the precise packaging and the containerizing of any liquid, quasi-liquid or material which function therealike wherein repeditive and reliable results are desired.

It is obvious that other modifications can be made of my invention with departing therefrom, and I desire to be limited only by the scope of the appended claims.

I claim:

1. The process of controllably regulating and depositing a quantity of substantially liquid material in a measuring means from a material containing supply tank wherein at least one feed line extends from said supply tank to said measuring means and at least one return line extends from said measuring means to said supply tank to form a closed loop comprising the steps of: providing a pressure differential between the said tank and said measuring means by way of said substantially liquid material and another immiscible fluid so that said differential is nonexistent when the said measuring means substantially contains its measured amount of said material, flowing said substantially liquid material through said closed loop system by way of the pressure differential from said supply into said measuring means until said differential is nonexistent and a static condition exists, thereby controllably regulating the quantity of said material; interrupting the loop system and emptying said measuring means of the material therein; completing the loop and repeating said flowing and interrupting steps.

2. The process of claim 1 wherein said closed loop is interrupted on the supply input side thereof.

3. The process of claim 2 wherein the return loop portion in said system is adjustable to increase or decrease the length of the loop path to thereby controllably regulate the quantity of substantial liquid material in said measuring means.

4. The process of claim 3 wherein the length of the loop path is adjusted within the measuring means.

5. A duel immiscible fluid system of using gravity without pump means for controlling fluid quantities and dispensing same comprising the steps of: forming a least two fluid passages from a supply of heavy fluid to a receiver of lighter immiscible fluid and causing the influence of gravity to displace said lighter immiscible fluid from said receiver to said supply by the said heavy fluid until a static condition is reached and then dispensing said fluid from said receiver and said system.

6. The process of claim 5 wherein said causing step includes placing said supply further from the center of the earth than said receiver.

7. The process of claim 6 wherein the said passages extend given depths into said receiver and at least one said passage functions as to conduct the said heavy fluid to the receiver and said at least one other passage conducts the lighter fluid away from said receiver and said causing step includes relatively modifying the depth of the said at least one other passage which conducts the lighter fluid so that said static condition occurs when a different relative ratio of fluids exists in at least said receiver for dispensing a different quantity therefrom.

8. The process of claim 7 wherein the said passage for conducting said heavy fluid is relatively disposed at a lower depth in said receiver that said at least one other passage.

9. In a process of dispensing fluid materials from a supply wherein gravity is the only motive force and is used beneficially and said supply is coupled to a cylinder by way of a feed line and a return vent line and which each extend a depth therein for gravity feeding said cylinder and flow is created by differential pressure of the fluid the improvement comprising the steps of: flowing said fluid from said supply through said feed line into said cylinder until said material is forced into said return vent line until flow stops when said differential pressure is nonexistent by reaching a static condition, interrupting flow from said supply and dispensing at least the said fluid material from said cylinder.

10. The process of claim 9 wherein the steps of flowing and interrupting and dispensing are repeated.

11. The process of claim 10 wherein said flowing step duration is modified by said return vent line being relatively relocated depthwise in said cylinder and the quantity being dispensed is thereby modified.

12. The process of claim 11 wherein an inert atmosphere occupies the system to neutralize affects of said fluid material.

* * * * *